US009573405B2

(12) United States Patent
Fu et al.

(10) Patent No.: US 9,573,405 B2
(45) Date of Patent: Feb. 21, 2017

(54) METHOD AND BLANKET FOR TRANSFERRING A PASTE IMAGE FROM ENGRAVED PLATE TO SUBSTRATE

(71) Applicant: LEE CHANG YUNG CHEMICAL INDUSTRY CORPORATION, Kaohsiung (TW)

(72) Inventors: Chuan-Jen Fu, Nantou County (TW); Ruoh-Huey Uang, Hsinchu County (TW); Wei-Ting Hong, Kaohsiung (TW); Hsin-Jung Lin, Taipei (TW)

(73) Assignee: LCY CHEMICAL CORP., Kaohsiung (TW)

( * ) Notice: Subject to any disclaimer, the term of this patent is extended or adjusted under 35 U.S.C. 154(b) by 0 days.

(21) Appl. No.: 14/624,401

(22) Filed: Feb. 17, 2015

(65) Prior Publication Data

US 2016/0236500 A1 Aug. 18, 2016

(51) Int. Cl.
*B41N 10/04* (2006.01)

(52) U.S. Cl.
CPC ..... *B41N 10/04* (2013.01); *B41N 2210/02* (2013.01); *B41N 2210/04* (2013.01); *B41N 2210/14* (2013.01)

(58) Field of Classification Search
CPC ..... B41M 1/10; B41N 10/04; B41N 10/02; B41N 10/00; B41N 1/00
See application file for complete search history.

(56) References Cited

U.S. PATENT DOCUMENTS 5,456,171 A * 10/1995 Biava ..... B41N 10/04 101/122
5,754,931 A * 5/1998 Castelli ..... B32B 27/12 399/297
5,832,824 A * 11/1998 Okubo ..... B41N 6/00 101/217
6,244,176 B1 * 6/2001 Sonobe ..... B41F 7/02 101/177
6,289,809 B1 * 9/2001 Sonobe ..... B41N 10/04 101/217
6,500,776 B2 * 12/2002 Hamada ..... B41N 10/02 428/909
6,848,364 B1 * 2/2005 Byers ..... B41F 13/193 101/217

(Continued)

FOREIGN PATENT DOCUMENTS

JP H06143858 A 5/1994
JP 2006159822 A 6/2006

(Continued)

OTHER PUBLICATIONS

Japanese Office Action dated Apr. 13, 2016, as issued in corresponding Japan Patent Application No. 2015-123344 (3 pages).

*Primary Examiner* — David Banh
(74) *Attorney, Agent, or Firm* — Muncy, Geissler, Olds & Lowe, P.C.

(57) ABSTRACT

A blanket for transferring a paste image from an engraved plate to a substrate is provided. The blanket includes a foam, a PET layer on the foam, and a paste transfer layer on the PET layer. The foam has a Shore A hardness of 20 to 80 and a thickness of 0.5 mm to 1.5 mm, wherein the foam has a higher Shore A hardness corresponding to a greater thickness.

24 Claims, 6 Drawing Sheets

(56) References Cited

U.S. PATENT DOCUMENTS 7,078,152 B2 * 7/2006 Rondon ..... B41C 1/1033 101/462
2002/0098758 A1 * 7/2002 Hamada ..... B41N 10/02 442/192
2002/0121206 A1 * 9/2002 Ooishi ..... B41C 1/1041 101/450.1
2003/0157285 A1 * 8/2003 Busshoff ..... B29C 63/20 428/36.4
2005/0181302 A1 * 8/2005 Kawamura ..... B41C 1/1025 430/270.1
2007/0214977 A1 * 9/2007 Okamoto ..... B41M 1/10 101/170
2007/0246500 A1 * 10/2007 Slikkerveer ..... B65H 23/02 226/7
2008/0085649 A1 * 4/2008 Salamero ..... B41F 35/00 442/327
2008/0156212 A1 * 7/2008 Yamada ..... B32B 1/08 101/375
2009/0297234 A1 * 12/2009 Cahill ..... G03G 15/2025 399/327
2011/0056397 A1 * 3/2011 Nishikawa ..... B41F 22/00 101/375
2011/0135899 A1 * 6/2011 Meltzer ..... B32B 27/12 428/217
2011/0277653 A1 * 11/2011 Nguyen ..... B41N 1/08 101/453
2012/0031746 A1 * 2/2012 Hwang ..... G06F 3/041 200/5 A
2012/0053020 A1 * 3/2012 Wright ..... B65G 15/34 482/54
2012/0322334 A1 * 12/2012 Kurihara ..... H01L 51/0023 445/24
2013/0008330 A1 * 1/2013 Yoo ..... B41N 10/04 101/401.1
2014/0060364 A1 * 3/2014 Liu ..... B41M 1/06 101/451
2015/0049153 A1 * 2/2015 Liu ..... B41J 2/47 347/225

FOREIGN PATENT DOCUMENTS

JP 2011148236 A 8/2011
JP 2012-81622 A 4/2012

* cited by examiner

METHOD AND BLANKET FOR TRANSFERRING A PASTE IMAGE FROM ENGRAVED PLATE TO SUBSTRATE

BACKGROUND

Technical Field

The disclosure relates to gravure offset printing, and in particular it relates to a blanket of the gravure offset printing.

Description of the Related Art

Printed electronic products possess great market potential. There is a continuing goal to miniaturize. To satisfy the design requirements of lighter, smaller, or thinner products, the volume of each component utilized in the product is strictly limited. Taking conductive wires—the most common component in printed electronic products—as an example, the line width thereof is reduced from the hundred-micron scale to a scale of just several microns. Screen printing is typically used in the manufacture of traditional conductive wires. However, the mass-producible line width is only down to 70 μm due to the intrinsic limitations of the screen. Obviously, such a process capability is insufficient for processing currently popular touch panels. To achieve fine wire production, most manufacturers rely on photolithographic technology. Although this process can produce wires with a line width less than 10 microns, the production cost is significantly higher than that of the printing process. Moreover, this process is not environmentally friendly because of the huge consumption of energy and materials.

To meet the production capacity of thin conductive paths and manufacturing cost considerations, gravure transfer (gravure offset printing) technology has seen a lot of research and trial production in industry in recent years, but the blanket of the gravure offset printing still needs to be improved. For example, the foam of the blanket influences the quality of the gravure offset printing, but no specific description of the relationship between the thickness and the hardness thereof is disclosed.

Accordingly, a foam with a specific relation of thickness and hardness for the blanket is called for.

BRIEF SUMMARY

One embodiment of the disclosure provides a blanket for transferring a paste image from an engraved plate to a substrate, comprising: a foam; a PET layer on the foam; and a paste transfer layer on the PET layer, wherein the foam has a Shore A hardness of 20 to 80 and a thickness of 0.5 mm to 1.5 mm, wherein the foam has a higher Shore A hardness corresponding to a greater thickness.

One embodiment of the disclosure provides a method of transferring a paste image from an engraved plate to a substrate, comprising: providing an engraved plate with an intaglio pattern; filling a paste into the intaglio pattern; transferring the paste in the intaglio pattern to the surface of a blanket; and transferring the paste on the blanket to a substrate, wherein the blanket includes: a foam; a PET layer on the foam; and a paste transfer layer on the PET layer, wherein the foam has a Shore A hardness of 20 to 80 and a thickness of 0.5 mm to 1.5 mm, wherein the foam has a higher Shore A hardness corresponding to a greater thickness.

A detailed description is given in the following embodiments with reference to the accompanying drawings.

BRIEF DESCRIPTION OF THE DRAWINGS

The disclosure can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
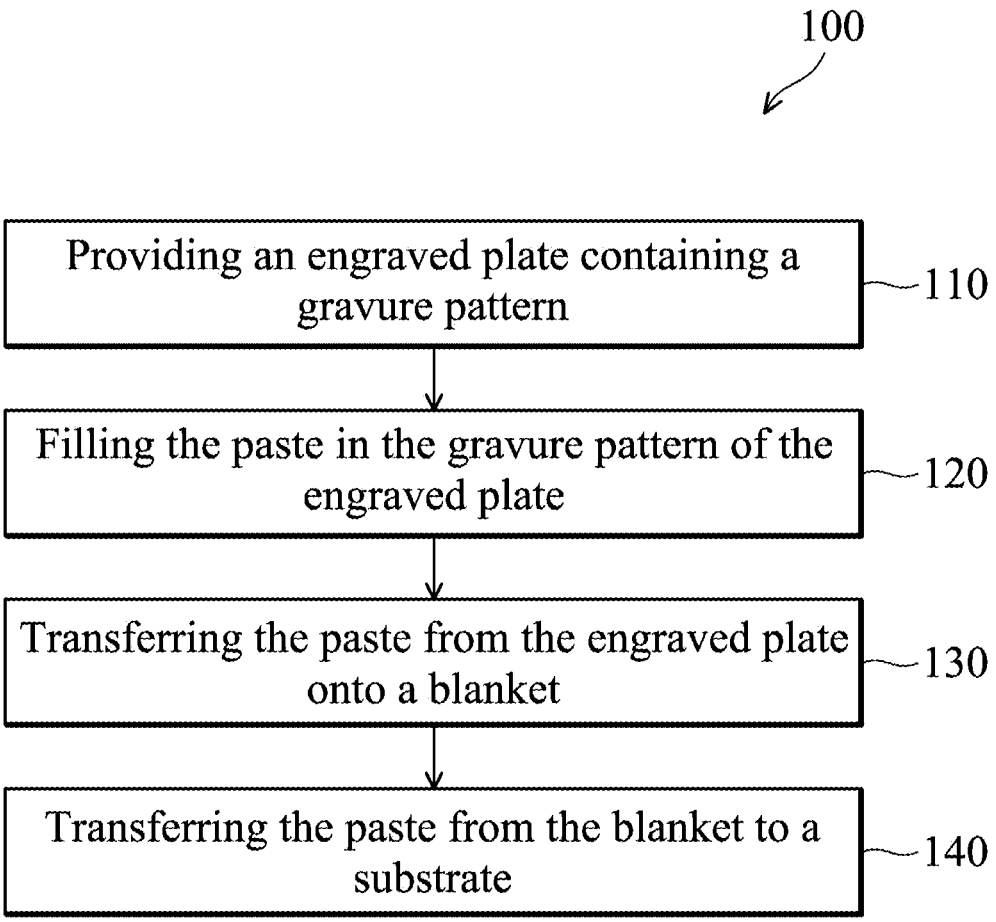
FIG. 1 shows a flowchart of the gravure offset printing process in one embodiment of the disclosure.
Figure 2A:
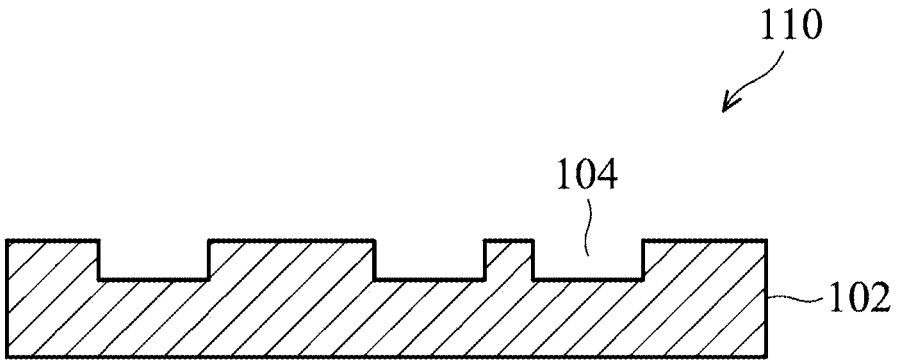
FIG. 2A-2E show schematic views of various stages of the gravure offset printing process in one embodiment of the disclosure.
Figure 2B:
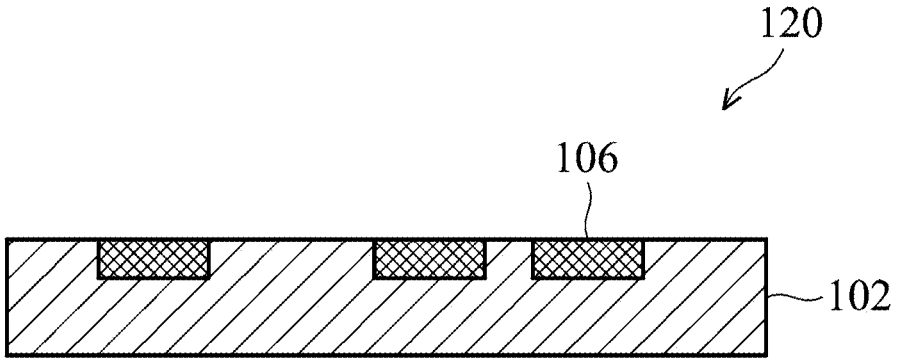

In one embodiment, a gravure transfer process flow is provided as shown in FIG. 1. Process 100 begins at step 110, in which an engraved plate 102 with an intaglio pattern 104 is provided. As shown in FIG. 2A, the intaglio pattern 104 may have a width, for example 3 to 100 μm. The engraved plate 102 can be made of stainless steel, glass, ceramic, copper, or a combination thereof. Subsequently, a paste 106 is filled into the intaglio pattern 104 in step 120. The excess paste 106 over the surface of the engraved plate 102 can be removed by a doctor blade, such that the top surface of the engraved plate 102 is flat, as shown in FIG. 2B. In one embodiment, the paste 106 can be made of metal nanoparticles (i.e. silver, copper, aluminum, and nickel), polymer (i.e. epoxy, PMMA, PU), and organic solvent.

Figure 2C:
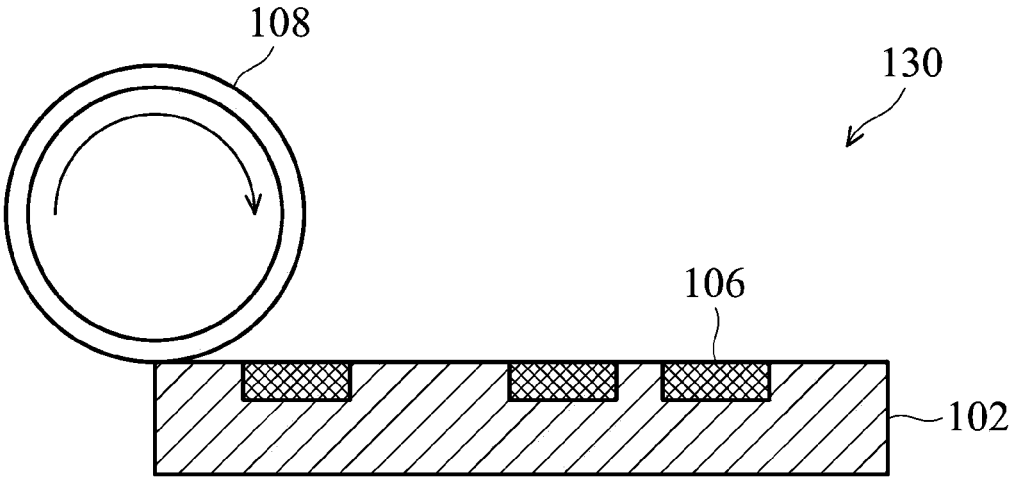
Figure 3:
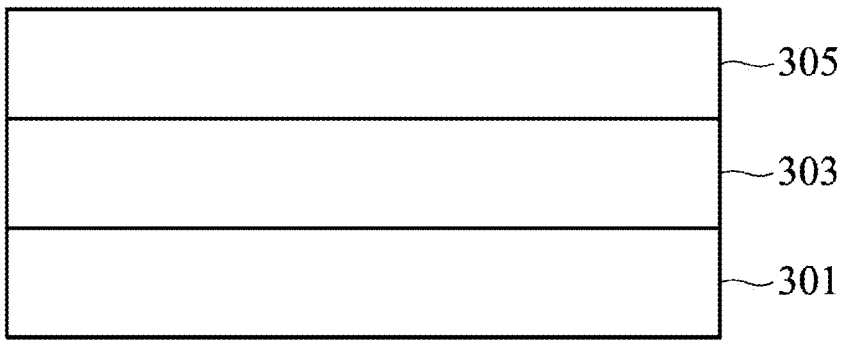
FIG. 3 shows a schematic view of the blanket in one embodiment.

Referring to FIG. 2C, the process 100 proceeds to step 130, in which the paste 106 in the intaglio pattern 104 is transferred to the surface of a blanket 108. The blanket 108 may be, for example, a roller shape. In one embodiment, the blanket 108 is a three-layered structure of a foam 301, a PET layer 303 on the foam 301, and a paste transfer layer 305 on the PET layer 303, as shown in FIG. 3. The three-layered structure can be rolled as a roll (the blanket 108 in FIG. 2C), and the paste transfer layer 305 is the outermost layer to transfer the paste 106. In the illustrated embodiment, the foam 301 has a Shore A hardness of 20 to 80 and a thickness of 0.5 mm to 1.5 mm, and the foam 301 has a higher Shore A hardness corresponding to a greater thickness.

The thickness range, the Shore A hardness range, and the relation between the thickness and the Shore A hardness of the foam 301 may make the blanket 108 have an engagement of 0.3 mm to 0.5 mm under a pressure of 0.15 MPa to 0.25 MPa. If the foam 301 has a different thickness/Shore A hardness/relation between the thickness and Shore A hardness from above description, the blanket 108 cannot have a suitable engagement under the pressure of 0.15 MPa to 0.25 MPa. Common sense dictates that the blanket 108 should have a larger engagement under a higher pressure. The blanket cannot have sufficient engagement to completely enter the recess of the intaglio pattern 104 under a pressure that is less than 0.15 MPa. The intaglio pattern 104 is easily deformed under a pressure that is higher than 0.25 MPa, such that the pattern of the paste 106 transferred onto the blanket 108 is twisted.

In one embodiment, the foam 301 can be made of polyurethane, polyethylene, nitrile-butadiene rubber, silicone, or a combination thereof with the density of 20.0 to 80.0 pcf. The foam 301 with an overly high or low density may make the foam 301 have an overly high or low Shore A hardness.

In one embodiment, the PET layer 303 has a Young's modulus of 3 to 5 GPa. In one embodiment, the PET layer 303 has a thickness of 100 μm to 300 μm. An overly thick PET layer may lead overly high hardness of blanket. An overly thin PET layer may lead overly low supporting capacity of blanket.

In one embodiment, the paste transfer layer 305 can be made of silicone rubber, fluoro rubber, fluorosilicone rubber, a combination thereof, or a multi-layered structure thereof. The rubber cured type can be used of addition cure, peroxide cure, condensation cure, UV cure, or the like. The paste transfer layer 305 may have a Shore A hardness of 40 to 60. A paste transfer layer with an overly high Shore A hardness may lead the insufficiency of blanket engagement into gravure. A paste transfer layer with an overly low Shore A hardness may lead blanket without the ability to maintain the shape of printing pattern and decrease durability. In one embodiment, the paste transfer layer 305 has a thickness of 0.5 to 1.0 mm. An overly thick paste transfer layer 305 may lead too much strain remained in blanket so that printing shape will twist and distort. An overly thin paste transfer layer 305 may lead whole blanket composite is too hard to print moderately, which results from the hardness of PET dominate the hardness of the whole blanket. The surface of the paste transfer layer 305 and water may have a contact angle of 100° to 130°. An overly low contact angle means the paste transfer layer 305 is more hydrophilic, and it may keep more paste on blanket and cannot complete 100% paste transfer. An overly high contact angle means the paste transfer layer 305 is too hydrophobic, and it may decrease the ability of taking paste from gravure. A surface of the paste transfer layer 305 may have a roughness of 0.050 μm to 0.200 μm. An overly high roughness of the surface of the paste transfer layer 305 may keep more paste on blanket and cannot complete 100% paste transfer, or maintain the shape of printing pattern hardly. An lower roughness of the surface of the paste transfer layer 305 is better for printing, but it may increase manufacture cost. Note that the Shore A hardness of the foam 301 may influence the thickness of the paste transfer layer 305. For example, the lower Shore A hardness of the foam 301 corresponds to a thinner thickness of the paste transfer layer 305 without changing the Shore A hardness of the paste transfer layer 305. Moreover, an adhesive (not shown) can be disposed between the foam 301 and the PET layer 303, between the PET layer 303 and the paste transfer layer 305, or a combination thereof. The adhesive may further enhance the adhesion between the layers in the blanket 108, thereby eliminating the chance of delamination during the gravure transfer process. The adhesive can be made of silicone, epoxy, silane, or a combination thereof.

Figure 2D:
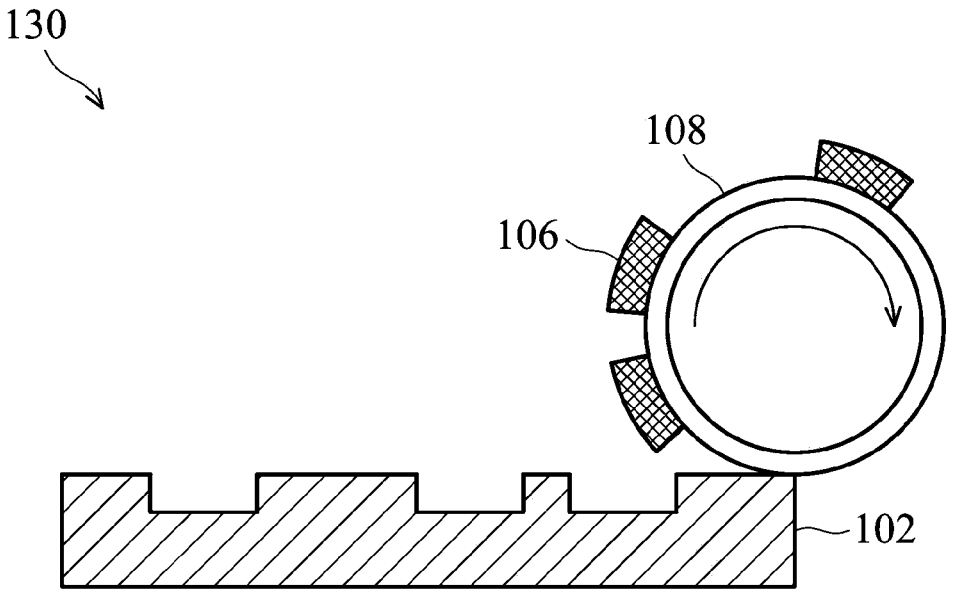
Figure 2E:
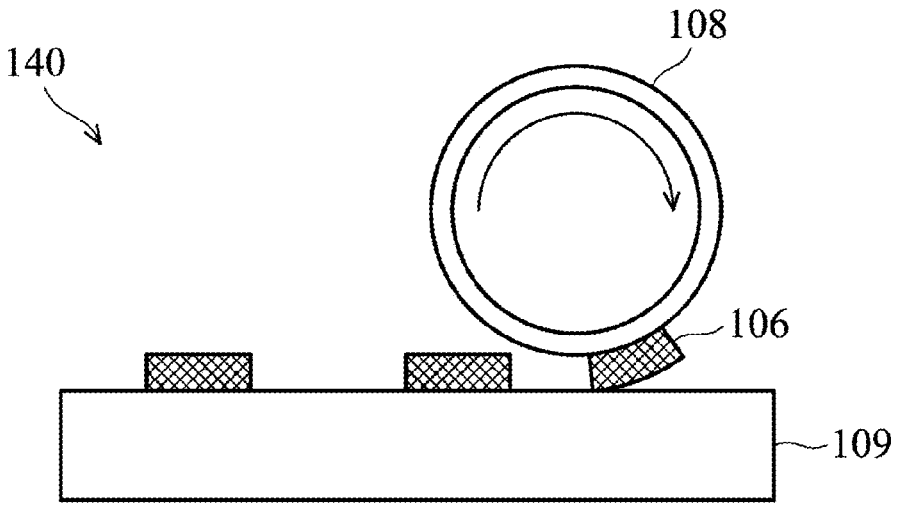

Referring to FIG. 2D, the process 100 proceeds to step 140, in which the paste 106 on the blanket 108 is transferred to a substrate 109. Note that although the substrate 109 is shown as being planar, the disclosure is not limited thereto. For example, the substrate 109 can be curved. The substrate 109 can be made of a rigid substrate or a flexible-type substrate, i.e. glass, polyethylene terephthalate (polyethylene terephthalate; PET), polycarbonate (PC), or a combination thereof.

It should be understood that the yield of the gravure transfer process is determined on two critical points: (1) the yield of the paste 106 transferred from the engraved plate 102 to the blanket 108, and (2) the yield of the paste 106 transferred from the blanket 108 to the substrate 109. In other words, the paste 106 tends to attach to the substrate 109 rather than attach to the blanket 108, and also tends to attach to the blanket 108 rather than to the engraved plate 102. The above attachment can be controlled by the pressure/temperature between the engraved plate 102 and the blanket 108 as well as between the blanket 108 and the substrate 109. In addition, the thickness, the Shore A hardness, and the relation between the thickness and the Shore A hardness of the foam 305 are also critical for the product yield.

Below, exemplary embodiments will be described in detail with reference to the accompanying drawings so as to be easily realized by a person having ordinary knowledge in the art. The inventive concept may be embodied in various forms without being limited to the exemplary embodiments set forth herein. Descriptions of well-known parts are omitted for clarity, and like reference numerals refer to like elements throughout.

EXAMPLES

Simulation Experiment 1

A PET layer with a thickness of 250 μm and Young's modulus of about 3 GPa. A foam with a thickness of 1.00 mm and Shore A hardness of 35, 20 and 80. A silicone layer (served as a paste transfer layer) with thickness of 0.75 mm and 1.00 mm and a Shore A hardness of 50. The PET layer could be adhered to the foam and the silicone layer by adhesive as shown in Table 1.

TABLE 1

| Simulation No. | Foam hardness | PET thickness | Silicone thickness | Silicone Hardness | Suitable engagement under Operable Pressure |
|---|---|---|---|---|---|
| 1-1 | 80 | 250 μm | 0.75 mm | 50 | Yes |
| 1-2 | 80 | 250 μm | 1.00 mm | 50 | Yes |
| 1-3 | 35 | 250 μm | 0.75 mm | 50 | Yes |
| 1-4 | 35 | 250 μm | 1.00 mm | 50 | No |
| 1-5 | 20 | 250 μm | 0.75 mm | 50 | No |
| 1-6 | 20 | 250 μm | 1.00 mm | 50 | No |

Figure 4:
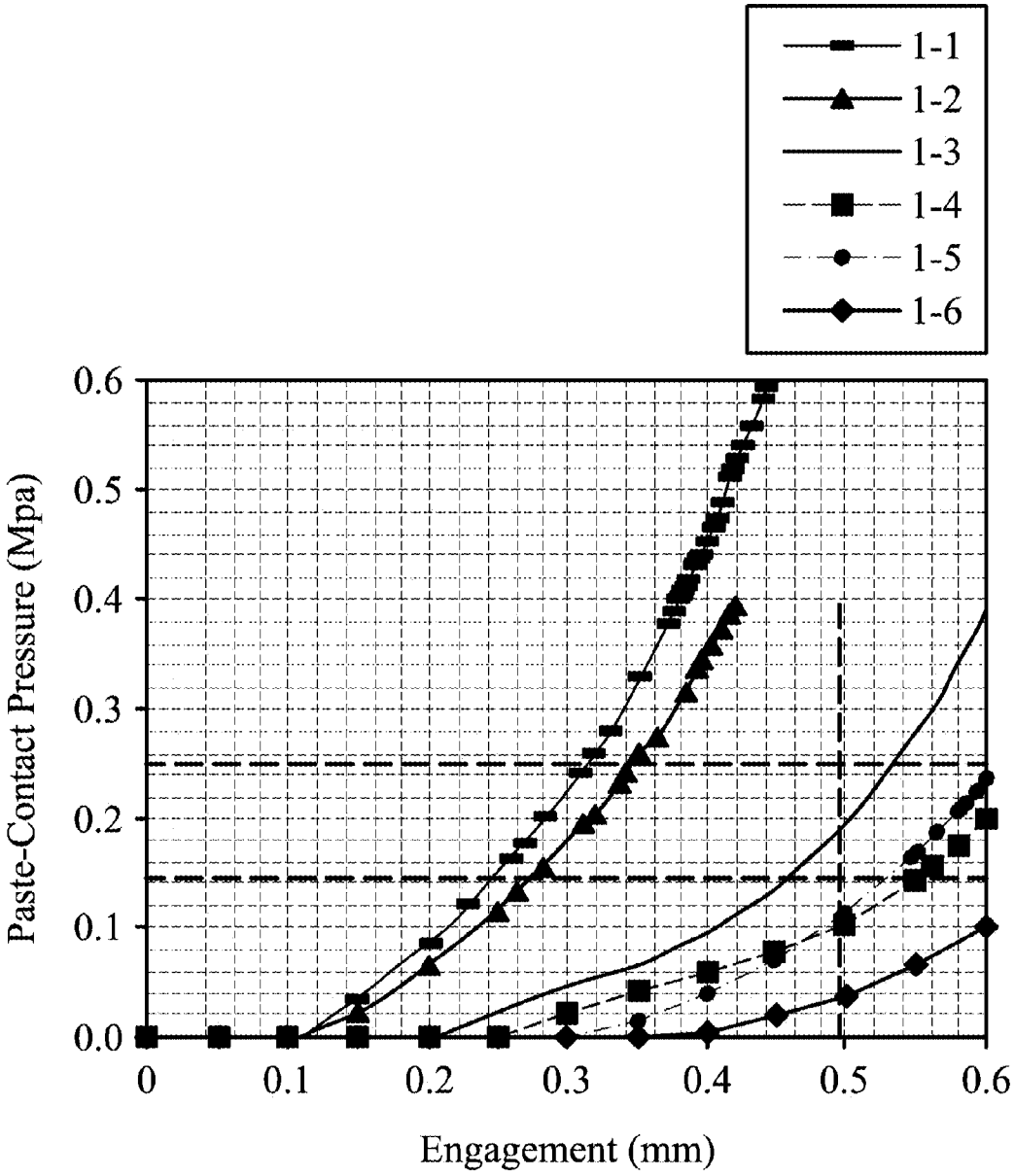
FIGS. 4 and 5 show curves of blanket engagement corresponding to pressure in simulation experiments.

The blanket was pressed by a pressure of 0-0.6 MPa to measure the engagement of the blanket, as shown in FIG. 4. The foam with a thickness of 1 mm and a lower Shore A hardness (i.e. 20) did not have a suitable engagement under a pressure of 0.15 MPa to 0.25 MPa. Moreover, the silicone layer could be thinned to match the high Shore A hardness of the foam, as shown in the comparison between Simulation 1-3 and 1-4.

Simulation Example 2

A PET layer with a thickness of 250 μm and Young's modulus of about 3 GPa. A foam with a thickness of 0.5 mm and Shore A hardness of 35, 20 and 80. A silicone layer (served a paste transfer layer) with thickness of 0.75 mm and 1.00 mm and a Shore A hardness of 50. The PET layer could be adhered to the foam and the silicone layer by adhesive as shown in Table 2.

TABLE 2

| Simulation No. | Foam hardness | PET thickness | Silicone thickness | Silicone Hardness | Suitable engagement under Operable Pressure |
|---|---|---|---|---|---|
| 2-1 | 80 | 250 μm | 0.75 mm | 50 | No |
| 2-2 | 80 | 250 μm | 1.00 mm | 50 | No |
| 2-3 | 35 | 250 μm | 0.75 mm | 50 | Yes |
| 2-4 | 35 | 250 μm | 1.00 mm | 50 | Yes |
| 2-5 | 20 | 250 μm | 0.75 mm | 50 | Yes |
| 2-6 | 20 | 250 μm | 1.00 mm | 50 | Yes |

Figure 5:
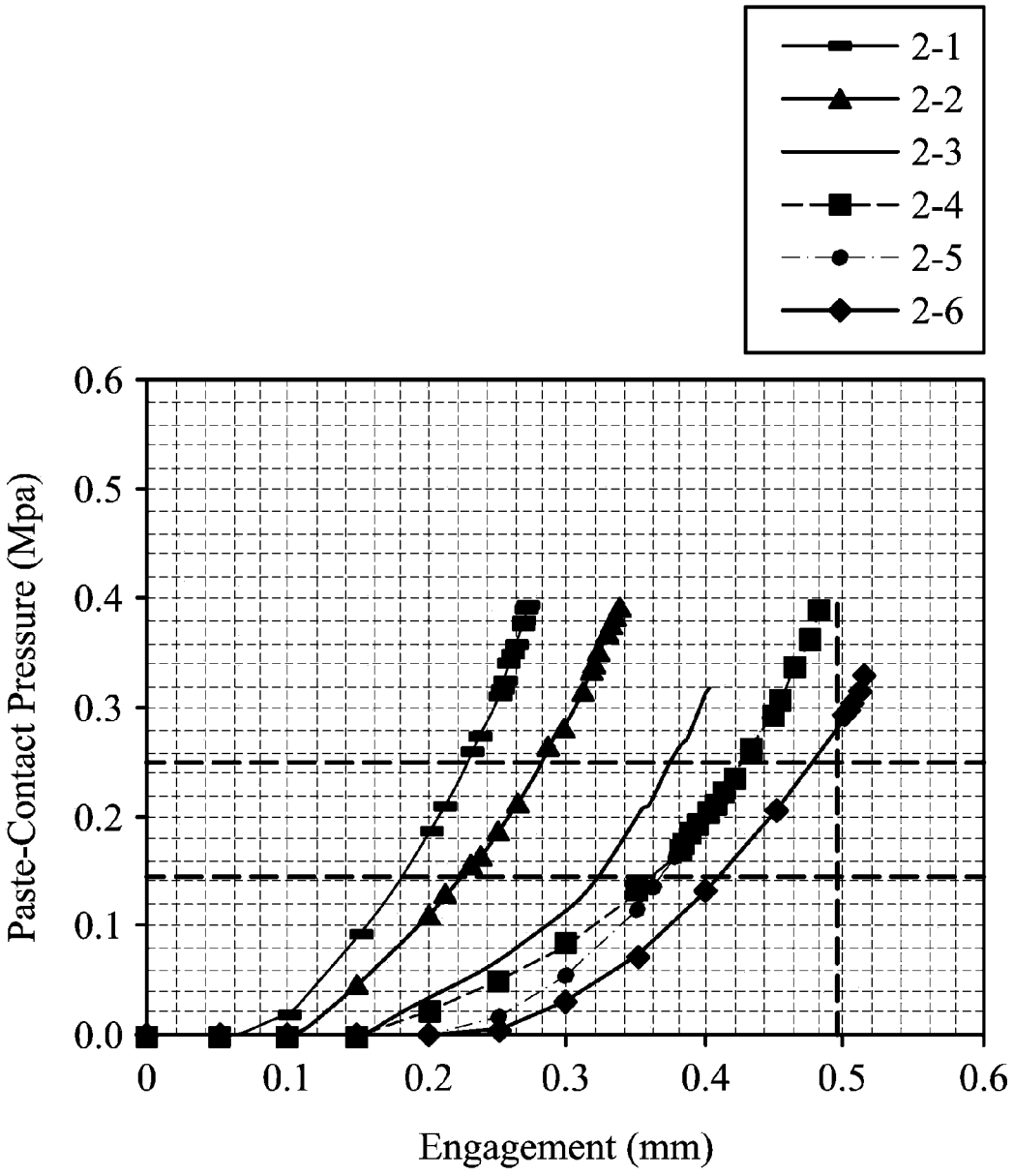

The blanket was pressed by a pressure of 0-0.6 MPa to measure the engagements of the blanket, as shown in FIG. 5. The foam with a thickness of 0.5 mm and a higher Shore A hardness (i.e. 80) did not have a suitable engagement under a pressure of 0.15 MPa to 0.25 MPa. According to FIGS. 4 and 5, the foam with a higher Shore A hardness should have a greater thickness, and the foam with a lower Shore A hardness should have a thinner thickness.

Accordingly, the blanket should have a foam (i.e. polyurethane) with an appropriate thickness corresponding its inherent Shore A hardness. The foam with a higher Shore A hardness may have a larger thickness, and the foam with a lower Shore A hardness may have a thinner thickness, respectively. As such, the blanket may have an appropriate engagement under a suitable pressure. If a foam with a lower Shore A hardness has a larger thickness, e.g. a PU film with a Shore A hardness of 20 and a thickness of 1 mm, the engagement of the blanket will be largely greater than 0.5 mm under the pressure of 0.15 MPa to 0.25 MPa. Similarly, if a foam with a higher Shore A hardness has a thinner thickness, e.g. a PU film with a Shore A hardness of 80 and a thickness of 0.5 mm, the engagement of the blanket will be lower than 0.3 mm under the pressure of 0.15 MPa to 0.25 MPa. Accordingly, not only the Shore A hardness range and the thickness of the foam are important, a higher Shore A hardness corresponding to a greater thickness of the foam is also critical to achieve the target of the disclosure.

Example 1

A PET layer with a thickness of 250 μm and Young's modulus of about 3 GPa was commercially available from ShinKong Materials Technology Co., Ltd. Polyurethane foams with a thickness of 1.0 mm and Shore A hardness of 35 was commercially available from Adheso Graphics Inc. A silicone layer (served as a paste transfer layer) with thickness of 0.75 mm and a Shore A hardness of 50 was commercially available from Shin-Etsu Silicone Taiwan Co. Two sides of the PET layer were adhered to the Polyurethane foam and the silicone layer by silicone, respectively, to complete a blanket.

A paste made from silver particles, polymer binder, and organic solvent was filled into an intaglio pattern of an engraved plate of stainless-steel or nickel, and the intaglio pattern had a depth of 15 μm and a width of 15 μm. The blanket (on a roll) was pressed to the engraved plate by a pressure of under 0.01 MPa to transfer the paste from the intaglio pattern onto the blanket, wherein the blanket had an engagement of 0.05 mm. The blanket could not have sufficient engagement to completely enter the recess of the intaglio pattern 104, and bubbles were easily occurred in the paste. The paste pattern was not good due to bubbles therein.

The blanket (on a roll) was pressed to the engraved plate by a pressure of 0.15 MPa to transfer the paste from the intaglio pattern onto the blanket, wherein the blanket had an engagement of 0.45 mm. The paste pattern was good without obvious problems.

Comparative Example 1

A PET layer with a thickness of 250 μm and Young's modulus of about 3 GPa was commercially available from ShinKong Materials Technology Co., Ltd. An under blanket (served as a foam) with a 1.6 mm and Shore A hardness of 80 was commercially available from Fujikura. A silicone layer (served as a paste transfer layer) with thickness of 0.75 mm and a Shore A hardness of 50 was commercially available from Shin-Etsu Silicone Taiwan Co. Two sides of the PET layer were adhered to the under blanket and the silicone layer by silicone, respectively, to complete a blanket.

A paste made from silver particles, polymer binder, and organic solvent was filled into an intaglio pattern of an engraved plate of stainless-steel or nickel, and the intaglio pattern had a depth of 15 μm and a width of 15 μm. The blanket (on a roll) was pressed to the engraved plate by a pressure of over 0.25 MPa to transfer the paste from the intaglio pattern onto the blanket, wherein the blanket had an engagement of 0.3 mm. The intaglio pattern 104 is easily deformed under a pressure that is higher than 0.25 MPa, such that the pattern of the paste 106 transferred onto the blanket 108 is twisted.

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A blanket for transferring a paste image from an engraved plate to a substrate, comprising:

a foam;

a PET layer on the foam, wherein the PET layer has a thickness of 250 μm and Young's modulus of 3 GPa; and a paste transfer layer on the PET layer, wherein the paste transfer layer is silicone rubber with a Shore A hardness of 50 and a thickness of 0.75 mm to 1.0 mm, wherein the foam has a Shore A hardness of 35 to 80 with a thickness of 1 mm, or a Shore A hardness of 20 to 35 with a thickness of 0.5 mm.

2. The blanket as claimed in claim 1, wherein the foam comprises polyurethane, polyethylene, nitrile-butadiene rubber, silicone, or a combination thereof.

3. The blanket as claimed in claim 1, wherein the PET layer has a Young's modulus of 3 to 5 GPa.

4. The blanket as claimed in claim 1, wherein the PET layer has a thickness of 100 μm to 300 μm.

5. The blanket as claimed in claim 1, wherein the silicone rubber, fluoro rubber, fluorosilicone rubber, a combination thereof, or a multi-layered structure thereof is cured by addition cure, peroxide cure, condensation cure, or UV cure.

6. The blanket as claimed in claim 1, wherein the paste transfer layer has a Shore A hardness of 40 to 60.

7. The blanket as claimed in claim 1, wherein the paste transfer layer has a thickness of 0.5 mm to 1.0 mm.

8. The blanket as claimed in claim 1, wherein a surface of the paste transfer layer and water have a contact angle of 100° to 130°.

9. The blanket as claimed in claim 1, wherein a surface of the paste transfer layer has a roughness of 0.050 μm to 0.200 μm.

10. The blanket as claimed in claim 1, further comprising an adhesive between the foam and the PET layer, between the PET layer and the paste transfer layer, or a combination thereof.

11. A method of transferring a paste image from an engraved plate to a substrate, comprising:

providing an engraved plate with an intaglio pattern;

filling a paste into the intaglio pattern;

transferring the paste in the intaglio pattern to the surface of a blanket; and transferring the paste on the blanket to a substrate, wherein the blanket includes:

a foam;

a PET layer on the foam, wherein the PET layer has a thickness of 250 μm and Young's modulus of 3 GPa; and a paste transfer layer on the PET layer, wherein the paste transfer layer is silicone rubber with a Shore A hardness of 50 and a thickness of 0.75 mm to 1.0 mm, wherein the foam has a Shore A hardness of 35 to 80 with a thickness of 1 mm, or a Shore A hardness of 20 to 35 with a thickness of 0.5 mm.

12. The method as claimed in claim 11, wherein the foam comprises polyurethane, polyethylene, nitrile-butadiene rubber, silicone, or a combination thereof.

13. The method as claimed in claim 11, wherein the PET layer has a Young's modulus of 3 to 5 GPa.

14. The method as claimed in claim 11, wherein the PET layer has a thickness of 100 μm to 300 μm.

15. The method as claimed in claim 11, wherein the paste transfer layer has a Shore A hardness of 40 to 60.

16. The method as claimed in claim 11, wherein the paste transfer layer has a thickness of 0.5 mm to 1.0 mm.

17. The method as claimed in claim 11, wherein a surface of the paste transfer layer and water have a contact angle of 100° to 130°.

18. The method as claimed in claim 11, wherein a surface of the paste transfer layer has a roughness of 0.050 μm to 0.200 μm.

19. The method as claimed in claim 11, further comprising an adhesive between the foam and the PET layer, between the PET layer and the paste transfer layer, or a combination thereof.

20. The blanket as claimed in claim 1, wherein the blanket has an engagement of 0.3 mm to 0.5 mm under a pressure of 0.15 MPa to 0.25 MPa.

21. The method as claimed in claim 11, wherein the blanket has an engagement of 0.3 mm to 0.5 mm under a pressure of 0.15 MPa to 0.25 MPa.

22. A method for forming a blanket, comprising:

providing a foam, wherein the foam has a Shore A hardness of 35 to 80 with a thickness of 1 mm, or a Shore A hardness of 20 to 35 with a thickness of 0.5 mm;

providing a PET layer on the foam, wherein the PET layer has a thickness of 250 μm and Young's modulus of 3 GPa; and providing a paste transfer layer on the PET layer, wherein the paste transfer layer is silicone rubber with a Shore A hardness of 50 and a thickness of 0.75 mm to 1.0 mm.

23. The blanket as claimed in claim 1, wherein the foam is polyurethane.

24. The method as claimed in claim 11, wherein the paste includes metal particles, polymer, and organic solvent.

* * * * *